United States Patent [19]

Iezuka et al.

[11] 4,434,759

[45] Mar. 6, 1984

[54] FUEL SUPPLY CUT CONTROL DEVICE OF AN INTERNAL COMBUSTION ENGINE

[75] Inventors: Isamu Iezuka; Kazuo Nakano, both of Okazaki, Japan

[73] Assignee: Toyota Jidosha Kabushiki Kaisha, Toyota, Japan

[21] Appl. No.: 427,297

[22] Filed: Sep. 29, 1982

[30] Foreign Application Priority Data

Mar. 24, 1982 [JP] Japan ..... 57-45534

[51] Int. Cl.[3] ..... F02D 5/00

[52] U.S. Cl. ..... 123/325; 123/333; 123/493

[58] Field of Search ..... 123/325, 332, 333, 371, 123/493, 198 DB, DIG. 11; 261/DIG. 19

[56] References Cited

U.S. PATENT DOCUMENTS 3,866,584 2/1974 Bigalke et al. ..... 123/493

4,207,845 6/1980 Semmler ..... 123/325

4,274,382 6/1981 Sugasawa et al. ..... 123/493

4,371,050 2/1983 Ikeura ..... 123/198 DB 4,392,467 7/1983 Miyagi et al. ..... 123/493

*Primary Examiner*—William A. Cuchlinski, Jr.

*Attorney, Agent, or Firm*—Finnegan, Henderson, Farabow, Garrett & Dunner

[57] ABSTRACT

A fuel supply cut control device comprising an electronic control unit for controlling the injecting operation of a fuel injector. When the throttle valve is closed to the idling position under an operating state where the engine speed is higher than the cut speed, the fuel injection of the fuel injector is stopped. After this, when the engine speed is reduced below the resume speed, the injecting operation of the fuel injector is started. When the vehicle speed is high, the cut speed and the resume speed are low, and when the vehicle speed is low, the cut speed and the resume speed are high.

5 Claims, 7 Drawing Figures

VEHICLE SPEED SENSOR
1
2
3
4
5
6
7
8
9
10
11
12
13
14
15
16
17
18
19
20
22
24
26
27
28

FUEL SUPPLY CUT CONTROL
50
IS THROTTLE SWITCH ON ?
NO
YES
52
VEHICLE SPEED V > V0
NO
YES
53
IS FLAG 1 SET ?
YES
NO
59
IS FLAG 2 SET ?
YES
NO

FUEL SUPPLY CUT CONTROL DEVICE OF AN INTERNAL COMBUSTION ENGINE

BACKGROUND OF THE INVENTION

The present invention relates to a fuel supply cut control device for use in an internal combustion engine.

In order to improve a specific fuel consumption, a fuel supply cut control device is known in which the supply of fuel is stopped when the engine is decelerated. In such a device, the supply of fuel is stopped as soon as the decelerating operation is started, and the supply of fuel is started again when the engine speed is reduced below a predetermined fixed speed (hereinafter referred to as a resume speed). After this, when the engine is decelerated again after the engine speed is increased beyond a predetermined fixed speed (hereinafter referred to as a cut speed), the supply of fuel is stopped again until the engine speed is reduced below the resume speed. In such a fuel supply cut control device, in order to further improve a specific fuel consumption, it is necessary to reduce the resume speed and the cut speed as much as possible. However, if the resume speed and the cut speed are reduced, when the engine speed is reduced below the resume speed and then the supply of fuel is stopped, or when the decelerating operation of the engine is started under an operating state wherein the engine speed is slightly higher than the cut speed, and then the supply of fuel is stopped, a large torque fluctuation which provides a shock for a vehicle occurs. As a result, the drivability of a vehicle deteriorates. Therefore, in a conventional fuel supply cut control device, it is difficult to reduce the resume speed and the cut speed.

SUMMARY OF THE INVENTION

An object of the present invention is to provide a fuel supply cut control device capable of improving a specific fuel consumption by reducing the resume speed and the cut speed while maintaining a good drivability.

According to the present invention, there is provided a fuel supply cut control device for use in an internal combustion engine of a vehicle, said engine having an intake passage, a throttle valve arranged in the intake passage, and fuel supply means for feeding fuel into the intake passage, said device comprising: first means actuated in response to a change in the degree of opening of the throttle valve and producing an output signal indicating that the throttle valve is in the idling position; second means detecting the engine speed and producing an output signal indicating the engine speed; third means detecting the vehicle speed and producing an output signal indicating the vehicle speed; and control means actuating said fuel supply means in response to the output signals of said first means, said second means and said third means for stopping the supply of fuel from said fuel supply means, when the throttle valve is closed to the idling position under an oprating state where the engine speed is higher than a predetermined cut speed, and for starting the supply of fuel from said fuel supply means when the engine speed is reduced below a predetermined resume speed, said cut speed and said resume speed being changed in accordance with the vehicle speed.

The present invention may be more fully understood from the description of a preferred embodiment of the invention set forth below, together with the accompanying drawings.

BRIEF DESCRIPTION OF THE DRAWINGS

In the drawings:

FIGS. 2, 2*a* and 2*b* are a circuit diagram of the electronic control unit illustrated in FIG. 1.

DESCRIPTION OF A PREFERRED EMBODIMENT

Figure 1:
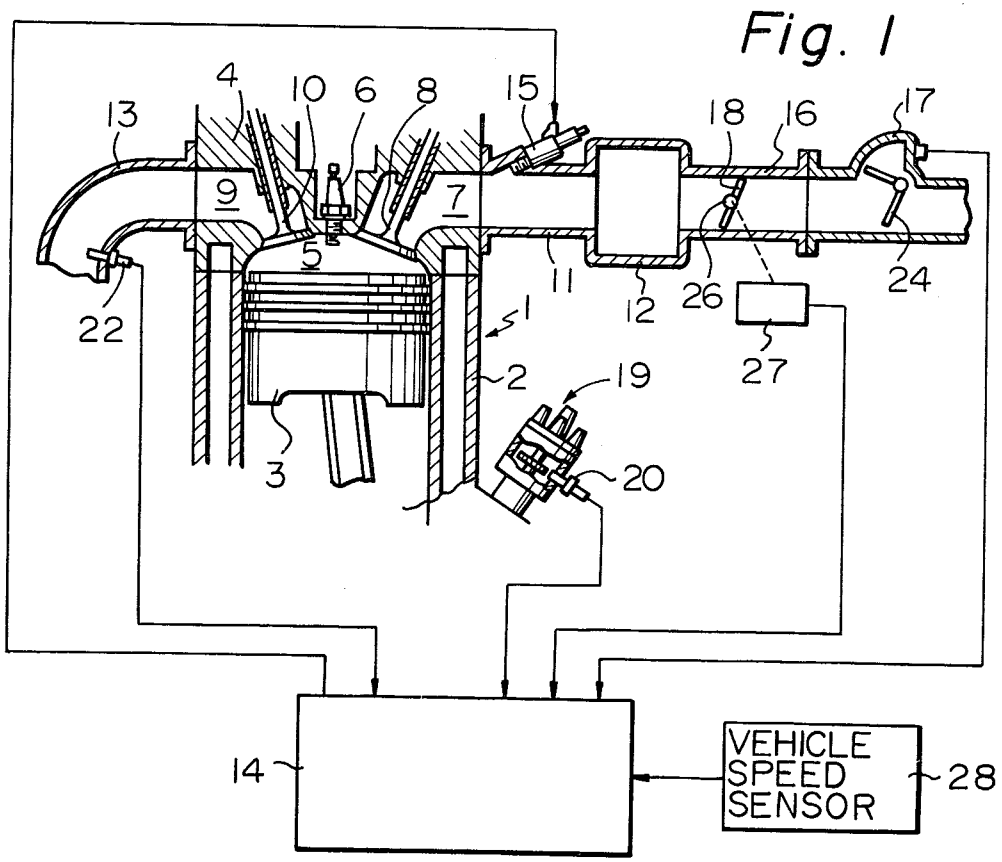
FIG. 1 is a cross-sectional side view of an internal combustion engine.

Referring to FIG. 1 reference numeral 1 designates an engine body, 2 a cylinder block, 3 a piston reciprocally movable in the cylinder block, and 4 a cylinder head fixed onto the cylinder block 2; 5 designates a combustion chamber formed between the piston 3 and the cylinder head 4, 6 a spark plug arranged in the combustion chamber 5, 7 an intake port, and 8 an intake valve; 9 designates an exhaust port, and 10 an exhaust valve. The intake port 7 is connected via the corresponding branch pipe 11 to a surge tank 12 which is common to all the cylinders, and the exhaust port 9 is connected to an exhaust manifold 13. A fuel injector 15, which is controlled by an electronic control unit 14, is provided for each cylinder and mounted on the corresponding branch pipe 11, and fuel is injected into each of the intake ports 7 from the corresponding fuel injector 15. The surge tank 12 is connected to the atmosphere via an intake pipe 16, an air flow meter 17, and an air cleaner (not shown). A throttle valve 18 is arranged in the intake pipe 16 and connected to an accelerator pedal (not shown) arranged in the driver's compartment. A rotating speed sensor 20, for detecting the rotating speed of the crank shaft (not shown) of the engine, is arranged in a distributor 19 mounted on the engine body 1, and the rotating speed sensor 20 is connected to the electronic control unit 14. On the other hand, an oxygen concentration detector 22 is arranged in the exhaust manifold 13 and connected to the electronic control unit 14. The oxygen concentration detector 22 produces an output voltage of about 0.1 volt, that is, issues a lean signal when the air-fuel ratio mixture fed into the cylinders is larger than the stoichiometric air-fuel ratio, while the oxygen concentration detector 22 produces an output voltage of about 0.9 volt, that is, issues a rich signal when the air-fuel ratio mixture fed into the cylinders is smaller than the stoichiometric air-fuel ratio. The air flow meter 17 has a metering plate 24 rotating in accordance with an increase in the amount of air, and the rotating angle of the metering plate 24 is converted to an output voltage. This output voltage is proportional to the amount of air and is fed into the electronic control unit 14. In addition, a throttle swith 27 is connected to a valve shaft 26 of the throttle valve 18 and connected to the electronic control unit 14. Furthermore, a vehicle speed sensor 28 is connected to the electronic control unit 14.

Figure 2A:
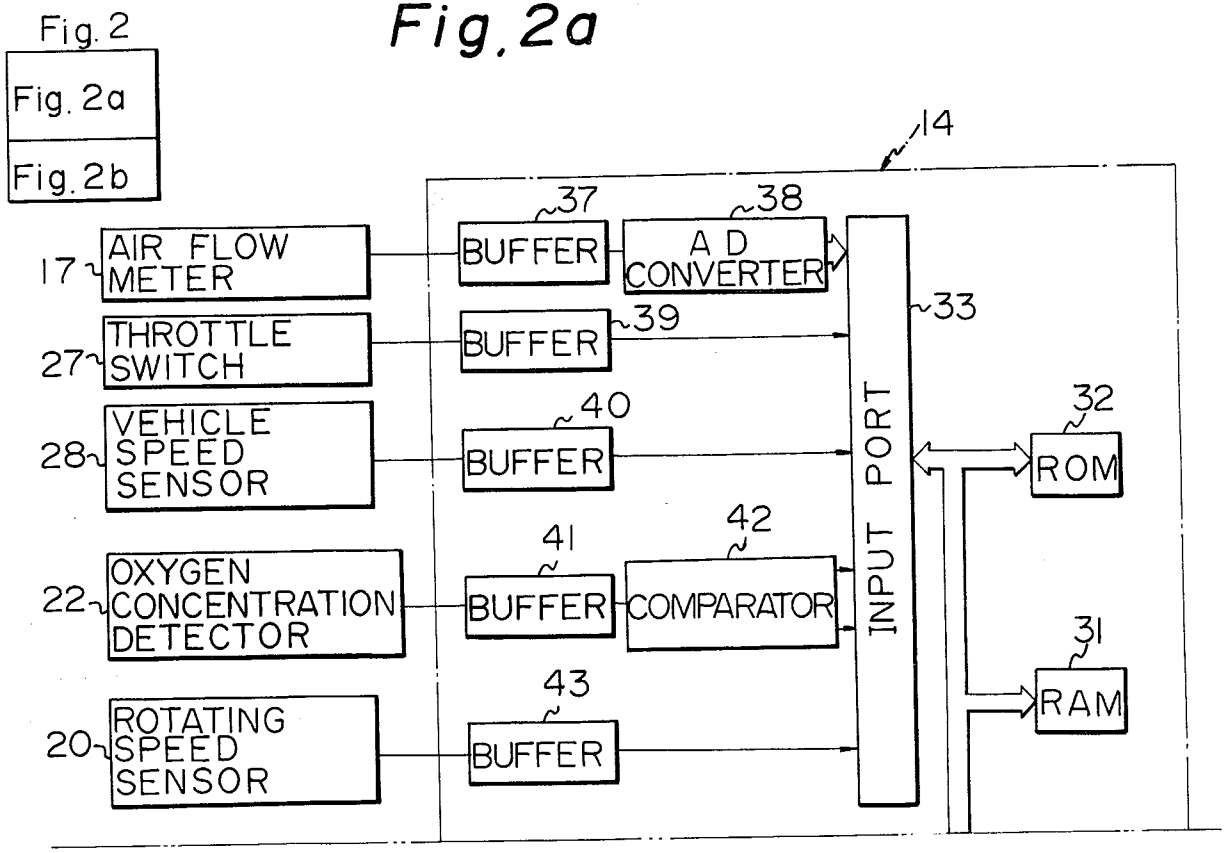
Figure 2B:
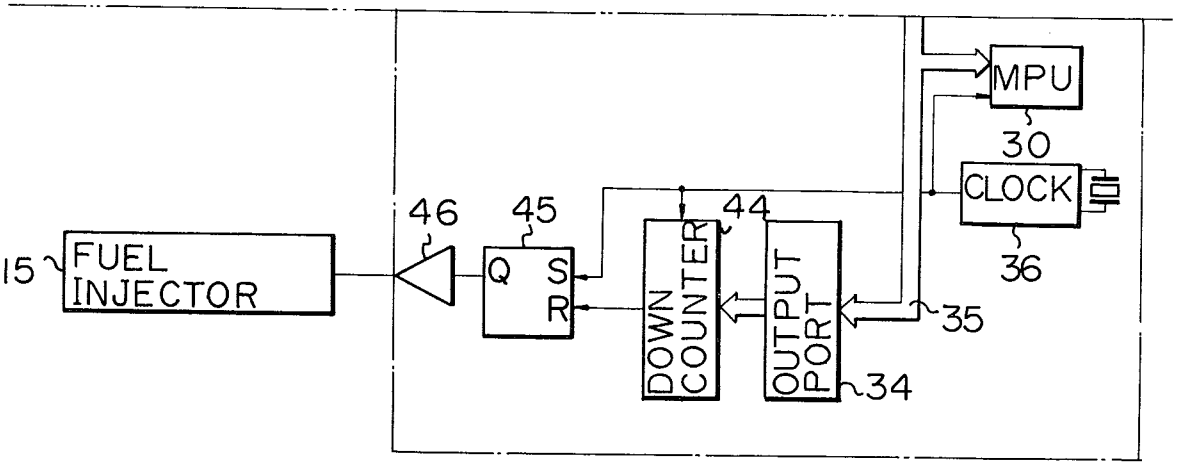

FIG. 2 illustrates the electronic control unit 14. Referring to FIG. 2, the electronic control unit 14 is constructed as a digital computer and comprises a microprocessor (MPU) 30 carring out the arithmetic and logic processing, a random-access memory (RAM) 31, a read-only memory (ROM) 32 storing a predetermined control program and arithmetic constant therein, input port 33 and output port 34. The MPU 30, the RAM 31, the ROM 32, the input port 33, and the output port 34 are interconnected to each other via bidirectional bus 35. In addition, the electronic control unit 14 comprises a clock generator 36 generating various clock signals. As illustrated in FIG. 2, the air flow meter 17 is connected to the input port 33 via a buffer amplifier 37 and an AD converter 38. As mentioned above, the air flow meter 17 produces an output voltage which is proportional to the amount of air fed into the cylinders. The output voltage of the air flow meter 17 is converted to the corresponding binary code in the AD converter 38, and then, this binary code is input into the MPU 30 via the input port 33 and the bus 35. The throttle switch 27 and the vehicle speed sensor 28 are connected to the input port 33 via buffer amplifiers 39 and 40, respectively. The throttle switch 27 is turned on when the throttle valve 18 is in the idling position, and the output signal of the throttle switch 27 is input into the MPU 30 via the input port 33 and the bus 35. The vehicle speed sensor 28 produces continuous output pulses, the number of which per a unit time is proportional to the vehicle speed, and the output pulses are input into the MPU 30 via input port 33 and bus 35. On the other hand, the output signal of the oxygen concentration detector 22 is input into comparator 42 via buffer amplifier 41 and, in the comparator 42, the output voltage of the oxygen concentration detector 22 is compared with a reference voltage of about 0.4 volt. When the output voltage of the oxygen concentration detector 22 is lower than the reference voltage, that is, when the oxygen concentration detector 22 issues the lean signal, the output voltage, produced at one of the output terminals of the comparator 42, becomes high. Contrary to this, when the output voltage of the oxygen concentration detector 22 is higher than the reference voltage, that is, when the oxygen concentration detector 22 issues the rich signal, the output voltage, produced at the other output terminal of the comparator 42, becomes high. The output voltage of the comparator 42 is input into the MPU 30 via the input port 33 and the bus 35, and thus, the output signal of the oxygen concentration detector 22 is always monitored by the MPU 30. In addition, the rotating speed sensor 20 is connected to the input port 33 via a buffer amplifier 43. The rotating speed sensor 20 produces an output pulse everytime the crank shaft of the engine is rotated by a predetermined crank angle, and the output pulse is input into the MPU 30 via the input port 35 and the bus 35.

The output port 34 is provided for outputting data necessary to actuate the fuel injector 15, and binary coded data is written in the output port 34 from the MPU 30 via the bus 35. The output terminals of the output port 34 are connected to the corresponding input terminals of a down counter 44. The down counter 44 is provided for converting the binary coded data, written in the output port 34, to the corresponding length of time. That is, the down count of the binary coded data fed into the down counter 44 from the output port 34 is started by the clock signal of the clock generator 36. After this, when the content of the down counter 44 reaches zero, the down count of the binary coded data is completed, and the down count completion signal is produced at the output terminal of the down counters 44. The reset input terminal R of S-R flip-flip 45 is connected to the output terminal of the down dounter 44, and the set input terminal S of the S-R flip-flop 45 is connected to the clock generator 36. The S-R flip-flop 45 is set by the clock signal of the clock generator 36 at the same time the down count of the down counter 44 is started, and the S-R flip-flop 45 is reset by the down count completion signal of the down counter 44 at the same time of the completion of the down count of the down counter 44. Consequently, the output voltage, produced at the output terminal Q of the flip-flop 45, becomes high during the time the down count of the down counter 44 is carried out. The output terminal Q of the flip-flop 45 is connected to the fuel injector 15 via a power amplifying circuit 46. Consequently, it is understood that the fuel injector 15 is actuated during the time the down count of the down counter 44 is carried out.

Figures 3, 3A, 3B:
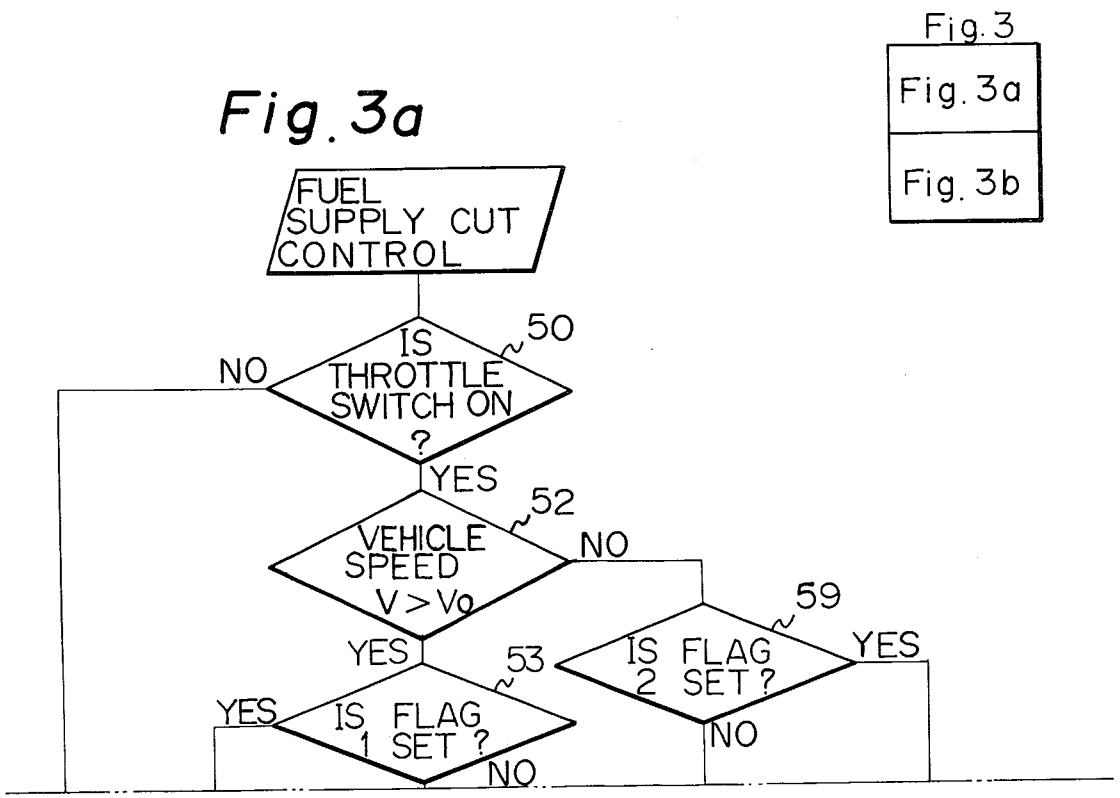
FIGS. 3, 3*a* and 3*b* are a flow chart illustrating an operation according to the present invention.
Figure 3B:
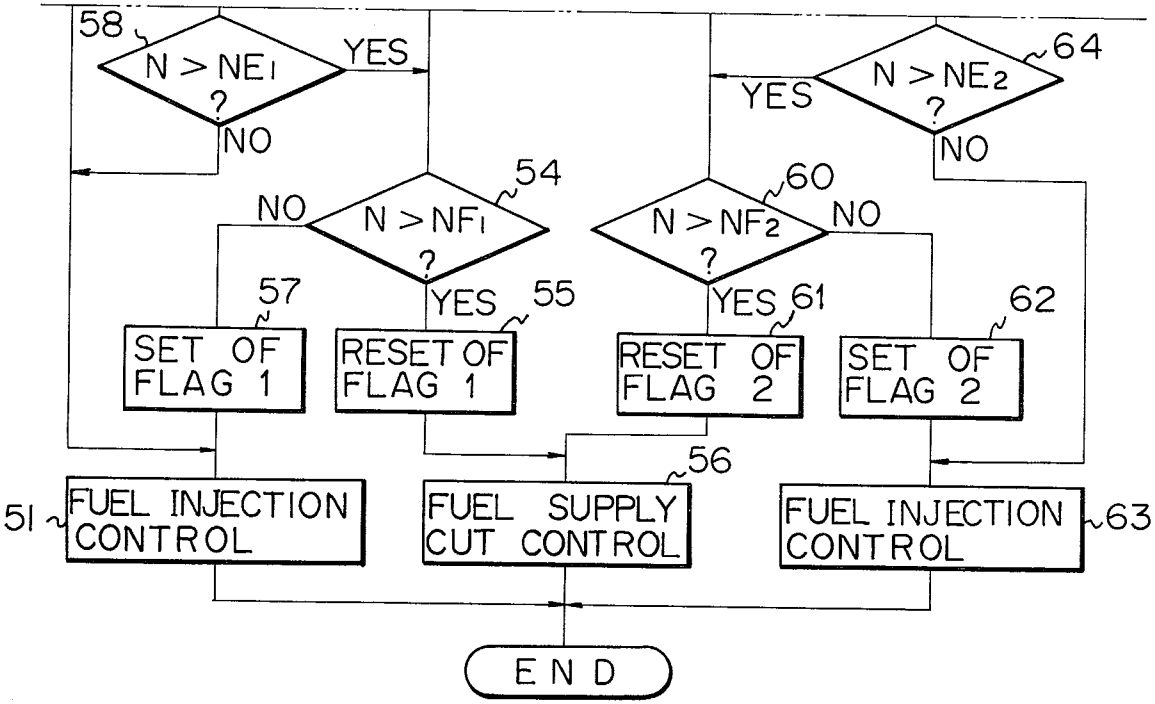

The operation of the fuel supply cut control according to the present invention will be hereinafter described with reference to a flow chart illustrated in FIG. 3. Referring to FIG. 3, initially, in step 50, it is determined whether the throttle switch 27 produces the on signal. When the throttle switch 27 does not produce the on signal, the routine goes to step 51, and the injection time of fuel is calculated. That is, in step 51, the basic injection time of fuel is calculated from the output signal of the air flow meter 17 and the output signal of the rotating speed sensor 20. Then, the basic injection time of fuel is corrected by the output signal of the oxygen concentration detector 22, and thus, an actual injection time of fuel, which is necessary to equalize an air-fuel ratio to the stoichiometric air-fuel ratio, is obtained. Then, fuel is injected from the fuel injector 15 during the actual injection time thus obtained.

If it is determined in step 50 that the throttle switch 27 produces the on signal, that is, when the throttle valve 18 is in the idling position, the rotine goes to step 52. In step 52, from the output signal of the vehicle speed sensor 28, it is determined whether the vehicle speed V is higher than a predetermined fixed speed $V_0$, for example, 30 km/hr. When the vehicle speed V is higher than the fixed speed $V_0$, the routine goes to step 53, and it is determined whether the flag 1 is set. Since the flag 1 is reset when the routine initially goes to step 53, the routine goes to step 54. In step 54, from the output signal of the rotating speed sensor 20, it is determined whether the number of revolutions per minute N of the engine is higher than the resume speed $NF_1$ or not, for example, 900 r.p.m. When the number of revolutions N is higher than the resume speed $NF_1$, the routine goes to step 55, and the flag 1 is reset. Then, in step 56, the supply of fuel is stopped. Consequently, it is understood that, when the throttle valve 18 is in the idling position, and when the number of revolutions N is higher than the resume speed $NF_1$, the injecting operation of the fuel injection 15 remains off.

When the number of speed N is reduced a little while after the deceleration of the engine is started, and thus, it is determined in stpe 54 that the number of revolution N is not higher than the resume speed $NF_1$, the routine goes to step 57. In step 57, the flag 1 is set, and then, in step 51, the injecting operation of the fuel injector 15 is started. When the number of revolutions N is reduced below the resume speed $NF_1$, the flag 1 is set as mentioned above. Therefore, in the next processing cycle, it is determined in step 53 that the flag 1 is set, and thus, the routine goes to step 58. In step 58, it is determined whether the number of revolutions N is higher than the cut speed $NE_1$ or not, for example, 1200 r.p.m. When the number of revolutions N is higher than the cut speed $NE_1$, the routine goes to step 54. Contrary to this, when the number of revolutions N is not higher than the cut speed $NE_1$, the routine goes to step 51, and the injecting operation of the fuel injector 15 is carried out. That is, when the number of revolutions N is increased by opening the throttle valve 18 after the number of revolutions N is reduced below the resume speed $NF_1$, if the throttle valve 18 is closed again to the idling position, the injecting operation of fuel is carried out or stopped in accordance with the number of revolutions N. That is, when the throttle valve 18 is closed again to the idling position as mentioned above, if the number of revolutions N is lower than the cut speed $NE_1$, the injecting operation of the fuel injector 15 is carried out. Contrary to this, when the throttle valve 18 is closed again to the idling position as mentioned above, if the number of revolutions N is higher than the cut speed $NE_1$, the injecting operation of the fuel injector 15 is stopped.

On the other hand, if it is determined in step 52 that the vehicle speed V is higher than the fixed speed $V_0$, the routine goes to step 59, and it is determined whether or not the flag 2 is set. Since the flag 2 is reset when the routine initially goes to step 59, the routine goes to step 60. In step 60, from the output signal of the rotating speed sensor 20, it is determined whether or not the number of revolutions per minute N of the engine is higher than the resume speed $NF_2$, for example, 1600 r.p.m. When the number of revolutions N is higher than the resume speed $NF_2$, the routine goes to step 61, and the flag 2 is reset. Then, in step 56, the supply of fuel is stopped. Consequently, it is understood that, when the throttle valve 18 is in the idling position, and when the number of revolutions N is higher than the resume speed $NF_2$, the injecting operation of the fuel injection 15 remains off.

When the number of speed N is reduced a little while after the deceleration of the engine is started, and thus, it is determined in step 60 that the number of revolutions N is not higher than the resume speed $NF_2$, the routine goes to step 62. In step 62, the flag 2 is set, and then in step 63, the injecting operation of the fuel injector 15 is started. When the number of revolutions N is reduced below the resume speed $NF_2$, the flag 2 is set as mentioned above. Therefore, in the next processing cycle, it is determined in step 59 that the flag 2 is set, and thus, the routine goes to step 64. In step 64, it is determined whether or not the number of revolutions N is higher than the cut speed $NE_2$, for example, 2000 r.p.m. When the number of revolution N is higher than the cut speed $NE_2$, the routine goes to step 60. Contrary to this, when the number of revolutions N is not higher than the cut speed $NE_2$, the routine goes to step 63, and the injecting operation of the fuel injector 15 is carried out. That is, when the number of revolutions N is increased by opening the throttle valve 18 after the number of revolutions N is reduced below the resume speed $NF_2$, if the throttle valve 18 is closed again to the idling position, the injecting operation of fuel is carried out or stopped in accordance with the number of revolutions N. That is, when the throttle valve 18 is closed again to the idling position as mentioned above, if the number of revolutions N is lower than the cut speed $NE_2$, the injecting operation of the fuel injector 15 is carried out. Contrary to this, when the throttle valve 18 is closed again to the idling position as mentioned above, if the number of revolutions N is higher than the cut speed $NE_2$, the injecting operation of the fuel injector 15 is stopped.

On the other hand, if the deceleration of the engine is started when the vehicle speed V is higher than the fixed speed $V_0$, and if the engine speed is reduced below the fixed speed $V_0$ during the deceleration, the routine goes to step 59. At this time, if the flag 2 is reset, that is, if the number of revolutions N has never been reduced below the resume speed $NF_2$ under an operating state where the vehicle speed V is lower than the fixed speed $V_0$, the routine goes to step 60. Then, if the number of revolutions N is higher than the resume speed $NF_2$, the injecting operation of the fuel injector 15 is stopped. Contrary to this, if the flag 2 is set, the routine goes to step 60 only when the number of revolutions N is higher than the cut speed $NE_2$. Then, if the number of revolutions N is higher than the resume speed $NF_2$, the injecting operation of the fuel injector 15 is stopped.

According to the present invention, as mentioned above, when the vehicle speed $V_0$ is higher than the fixed speed $V_0$, the resume speed $NF_1$ is equal to, for example, 900 r.p.m., and the cut speed $NE_1$ is equal to, for example, 1200 r.p.m. Contrary to this, when the vehicle speed V is lower than the fixed speed $V_0$, the resume speed $NF_2$ is equal to, for example, 1600 r.p.m., and the cut speed $NF_2$ is equal to, for example, 2000 r.p.m. That is, in the present invention, $NF_1$, $NE_1$, $NF_2$, and $NE_2$ are so determined that $NF_1$ is smaller than $NF_2$, and that $NE_1$ is smaller than $NE_2$. When the vehicle speed is high, the vehicle has a large inertia. Consequently, even if the resume speed $NF_1$ and the cut speed $NE_1$ is low, a chock, caused by a torque fluctuation occuring when the supply of fuel is started and stopped, does not affect a driver. Therefore, even if the resume speed $NF_1$ and the cut speed $NE_1$ are low when the vehicle speed is high, it is possible to obtain a good drivability. As mentioned above, in the present invention, by determining the resume speed and the cut speed so that they are low at least when the vehicle speed is high, it is possible to improve a specific fuel consumption.

While the invention has been described by reference to a specific embodiment, chosen for purposes of illustration, it should be apparent that numerous modifications can be made thereto by those skilled in the art without departing from the basic concept and scope of the invention.

We claim:

1. A fuel supply cut control device for use in an internal combustion engine of a vehicle, said engine having an intake passage, a throttle valve arranged in the intake passage, and fuel supply means for feeding fuel into the intake passage, said device comprising:

first means actuated in response to a change in the degree of opening of the throttle valve and producing an output signal indicating that the throttle valve is in the idling position;

second means detecting the engine speed and producing an output signal indicating the engine speed;

third means detecting the vehicle speed and producing an output signal indicating the vehicle speed; and control means actuating said fuel supply means in response to the output signals of said first means, said second means and said third means for stopping the supply of fuel from said fuel supply means when the throttle valve is closed to the idling position under an operating state where the engine speed is higher than a predetermined cut speed and for starting the supply of fuel from said fuel supply means when the engine speed is reduced below a predetermined resume speed, said cut speed and said resume speed being changed in accordance with the vehicle speed.

2. A device according to claim 1, wherein said cut speed is equal to a first speed when the vehicle speed is lower than a predetermined speed, said cut speed being equal to a second speed which is lower than said first speed when the vehicle speed is higher than the predetermined speed.

3. A device according to claim 2, wherein said first speed is equal to about 2000 r.p.m., and said second speed is equal to about 1200 r.p.m.

4. A device according to claim 1, wherein said resume speed is equal to a first speed when the vehicle speed is lower than a predetermined speed, said resume speed being equal to a second speed which is lower than said first speed when the vehicle speed is higher than the predetermined speed.

5. A device according to claim 4, wherein said first speed is equal to about 1600 r.p.m., and said second speed is equal to about 900 r.p.m.

* * * * *